US010799077B2

(12) United States Patent
deLoache, III et al.

(10) Patent No.: US 10,799,077 B2
(45) Date of Patent: Oct. 13, 2020

(54) LIGATURE-RESISTANT PAPER TOWEL DISPENSER

(71) Applicant: BEHAVIORAL SAFETY PRODUCTS, LLC, Watkinsville, GA (US)

(72) Inventors: Robert Lee deLoache, III, Watkinsville, GA (US); David Cory deLoache, Watkinsville, GA (US); Mark Mendes, Loganville, GA (US)

(73) Assignee: BEHAVIORAL SAFETY PRODUCTS, LLC, Athens, GA (US)

( * ) Notice: Subject to any disclaimer, the term of this patent is extended or adjusted under 35 U.S.C. 154(b) by 310 days.

(21) Appl. No.: 15/987,295

(22) Filed: May 23, 2018

(65) Prior Publication Data

US 2019/0357736 A1 Nov. 28, 2019

(51) Int. Cl.
*A47K 10/38* (2006.01)

(52) U.S. Cl.
CPC ..... *A47K 10/3836* (2013.01)

(58) Field of Classification Search
CPC ..... A47K 10/3836; A47K 10/3818; A47K 2010/3233
See application file for complete search history.

(56) References Cited

U.S. PATENT DOCUMENTS 1,815,855 A 7/1931 Lauritano
2,650,948 A 9/1953 Findlay
2,805,112 A * 9/1957 Krueger ..... A47K 10/38 312/242
2,860,348 A 11/1958 McClenahan
3,331,106 A 7/1967 Ruskin
3,495,276 A 2/1970 Suess
(Continued)

FOREIGN PATENT DOCUMENTS

CN 101484056 B 5/2011
FR 2432293 2/1980
(Continued)

OTHER PUBLICATIONS

U.S. Appl. No. 15/857,795, filed Dec. 29, 2017, deLoache, III.
(Continued)

*Primary Examiner* — William A. Rivera
(74) *Attorney, Agent, or Firm* — Mitch Harris, Atty at Law; Andrew M. Harris

(57) ABSTRACT

A ligature-resistant paper towel dispenser includes a rear portion with a towel recess for receiving a roll of paper towels and a planar mounting area for securing the paper towel dispenser to a wall. A front portion of the dispenser locks to the rear portion, covers the roll and completes the shape of the paper towel dispenser exterior. The mounting area of the housing may extend backwards from the planar mounting area into an aperture formed through a surface of the wall so that the towel recess projects into the wall. The housing has an upward projecting exterior that is curved or inclined downward from an apex to prevent attachment of a ligature and extends above the towel recess by a distance greater than or equal to half of a maximum forward projection of the housing to provide sufficient curvature or inclination of the exterior of the top projection.

24 Claims, 14 Drawing Sheets

(56) References Cited

U.S. PATENT DOCUMENTS

| | | | | |
|---|---|---|---|---|
| 3,573,344 | A | 4/1971 | Snyder | |
| 3,729,113 | A | 4/1973 | Lopatka | |
| 3,890,459 | A | 6/1975 | Caveney | |
| 3,901,406 | A | 8/1975 | Kivett | |
| 3,924,279 | A | 12/1975 | Morris et al. | |
| 3,987,502 | A | 10/1976 | Hartmann | |
| D261,799 | S | 11/1981 | Alger | |
| D264,620 | S | 5/1982 | Kaiser | |
| 4,558,472 | A | 12/1985 | Fromme et al. | |
| D284,303 | S | 6/1986 | Yvetot | |
| 4,719,321 | A | 1/1988 | Kozel et al. | |
| 4,775,121 | A | 10/1988 | Carty | |
| D308,819 | S | 6/1990 | Anscher | |
| D311,242 | S | 10/1990 | Reid | |
| 4,962,550 | A | 10/1990 | Ikenaga et al. | |
| 5,210,913 | A | 5/1993 | Clark | |
| 5,224,674 | A | 7/1993 | Simons | |
| 5,251,340 | A | 10/1993 | Su-Land | |
| 5,389,082 | A | 2/1995 | Baugues et al. | |
| 5,649,676 | A * | 7/1997 | Lord | A47K 10/3827 242/595 |
| 5,680,949 | A | 10/1997 | Roesler | |
| 5,795,335 | A | 8/1998 | Zinreich | |
| 5,870,805 | A | 2/1999 | Kandler et al. | |
| 5,913,692 | A | 6/1999 | Targett | |
| D412,974 | S | 8/1999 | Birsel et al. | |
| 6,099,340 | A | 8/2000 | Florentine | |
| 6,129,109 | A | 10/2000 | Humber | |
| D438,939 | S | 3/2001 | Kawamura | |
| D450,570 | S | 11/2001 | Murata | |
| 6,687,922 | B1 | 2/2004 | Marshall et al. | |
| 6,736,669 | B1 | 5/2004 | Martin et al. | |
| 6,908,059 | B2 | 6/2005 | Budz et al. | |
| D509,575 | S | 9/2005 | Kergoet | |
| D539,232 | S | 3/2007 | Lozano | |
| 7,457,506 | B1 | 11/2008 | Osborne, II | |
| 7,565,706 | B2 | 7/2009 | Janssen | |
| D597,493 | S | 8/2009 | Wu | |
| D644,501 | S | 9/2011 | Chen | |
| D680,083 | S | 4/2013 | Olson | |
| D706,225 | S | 6/2014 | deLoache, III | |
| D733,270 | S | 6/2015 | Hao | |
| 9,297,154 | B2 | 3/2016 | deLoache, III | |
| 9,309,993 | B2 | 4/2016 | Hall | |
| 9,585,528 | B2 | 3/2017 | Khamphilapanyo et al. | |
| D792,955 | S | 7/2017 | deLoache, III | |
| 9,938,704 | B2 | 4/2018 | deLoache, III | |
| 2004/0135039 | A1 | 7/2004 | Reichert et al. | |
| 2005/0189453 | A1 | 9/2005 | DeGuevara | |
| 2006/0102769 | A1 * | 5/2006 | Wieser | A47K 10/38 242/560 |
| 2011/0308046 | A1 | 12/2011 | Weiss | |
| 2013/0240660 | A1 * | 9/2013 | Greer | A47K 10/3836 242/597.5 |
| 2016/0174778 | A1 * | 6/2016 | Khamphilapanyo | B26F 3/02 312/349 |
| 2018/0020886 | A1 | 1/2018 | Boeltl | |
| 2019/0191934 | A1 * | 6/2019 | Miedzius | A47K 5/1207 |
| 2020/0069121 | A1 * | 3/2020 | Boeltl | A47K 10/424 |

FOREIGN PATENT DOCUMENTS

| | | |
|---|---|---|
| FR | 2667854 | 8/1993 |
| KR | 19940008645 | 5/1994 |

OTHER PUBLICATIONS

Cape Cod Systems, "Paper Towel Dispensers" downloaded from https://www.capecodsystemscompany.com/store/paper-towel-dispensers,category.asp on Mar. 23, 2018, 7 pages (pp. 1-7 in pdf).

Kingsway Group, "KGO2 Ligature Resistant Paper Towel Dispenser" downloaded from http://www.kingswaygroupglobal.com/products/kg02-ligature-resistant-paper-towel-dispenser/ on Mar. 23, 2018, 4 pages (pp. 1-4 in pdf).

Sustainable Supply, "Georgia Pacific CenterPull Hand Towel Dispenser" downloaded from https://www.sustainablesupply.com/Georgia-Pacific-CenterPull-Hand-Towel-Dispenser-9-1-4w-x-8-3-4d-x-11-1-2h-Smoke-GPC582-04-C1958890?CAWELAID=12020504000206167 6&CAGPSPN=pla&CAAGID=41281995749&CATCI=pla-374717576338&gclid=Cj0KCQjwre_XBRDVARIsAPf7zZh-jhlA7rxGRHdPTzTMZYkX8wZuAa1qQGShbF6OV6vErm4gG6eQ8moaAqlyEALw_wcB on Mar. 23, 2018, 1 page.

Restroom Direct, "Bradley 234-000000 Paper Towel Dispenser & Waste Receptacle", downloaded from http://www.restroomdirect.com/bradley-234-combo-dispenser-waste.aspx?gclid=Cj0KCQjw0PTXBRCGARIsAKNYfG0tjQqlsCfQV1gO0BM3CBWyu1yU8UAfTTbkablh6fi9j19mdc_9IAaAqqgEALw_wcB on May 17, 2018, 3 pages (pp. 1-3 in pdf).

* cited by examiner

LIGATURE-RESISTANT PAPER TOWEL DISPENSER

BACKGROUND OF THE INVENTION

1. Field of the Invention

The present invention relates generally to paper towel dispensers, and in particular, to a paper towel dispenser around which a ligature does not anchor.

2. Description of the Related Art

Ligature-resistant design is a requirement in many institutional locations. In particular, in rooms where persons may be left unattended and where there is a risk that fixtures may be used as a support to tie a ligature, such as a belt, rope or a cloth, a way to ensure that the fixtures cannot be used in such a manner is desirable. In general, ligature-resistant design is an issue that exists any height above the floor, since objects above the floor can be used to support a ligature, even if one is not attachable.

Paper towel dispensers having locking features are in common-use in public places and private facilities such as hospitals, mental health facilities and incarceration facilities. In such private facilities it is desirable to secure paper towel rolls for both use conservation and sanitation, as in public facilities. Commercial paper towel dispensers are not suitable ligature-resistant designs and typically provide a broad, flat upper surface around which a ligature can be attached.

Therefore, it would be desirable to provide a paper towel dispenser that prevents ligature formation and/or support of such ligatures.

SUMMARY OF THE INVENTION

The above objectives, among others, are achieved in a ligature-resistant paper towel dispenser and a method of dispensing paper towels.

The ligature-resistant paper towel dispenser includes a housing having a towel recess for receiving a roll of paper towels. A rear face of the housing has a planar mounting area for securing the paper towel dispenser to a wall. The housing has a top projection having an exterior that is curved or inclined downward from an apex to prevent attachment of a ligature and the exterior of the top projection extends above the towel recess by a distance greater than or equal to half of a maximum forward projection of the exterior of the top projection to provide sufficient curvature or inclination of the exterior of the top projection of the housing. The ligature-resistant paper towel dispenser also includes a locking mechanism for securing the housing over the roll of paper towels.

The foregoing and other objectives, features, and advantages of the invention will be apparent from the following, more particular, description of the preferred embodiment of the invention, as illustrated in the accompanying drawings.

BRIEF DESCRIPTION OF THE DRAWINGS

The novel features believed characteristic of the invention are set forth in the appended claims. The invention itself, however, as well as a preferred mode of use, further objectives, and advantages thereof, will best be understood by reference to the following detailed description of an illustrative embodiment when read in conjunction with the accompanying drawings, wherein like reference numerals indicate like components, and:

DESCRIPTION OF ILLUSTRATIVE EMBODIMENT

The present disclosure illustrates paper towel dispensers that provide ligature-resistant structure and installation. The ligature-resistant paper towel dispensers have a housing that covers a paper towel roll and provide an outlet for dispensing the paper towels at the bottom of the housing. The housing has a curved or inclined shape at the top to which a ligature is not attachable. Ligature-resistance is further provided by a planar mounting surface at the rear of the housing that may be in the form of a flange that extends around the housing and securely affixes the housing to the wall at the periphery of the housing to prevent insertion of a ligature behind the housing. The illustrated example is a molded plastic assembly formed from transparent or semi-transparent materials, although the invention is not limited as to materials or techniques of fabrication.

Figure 1:
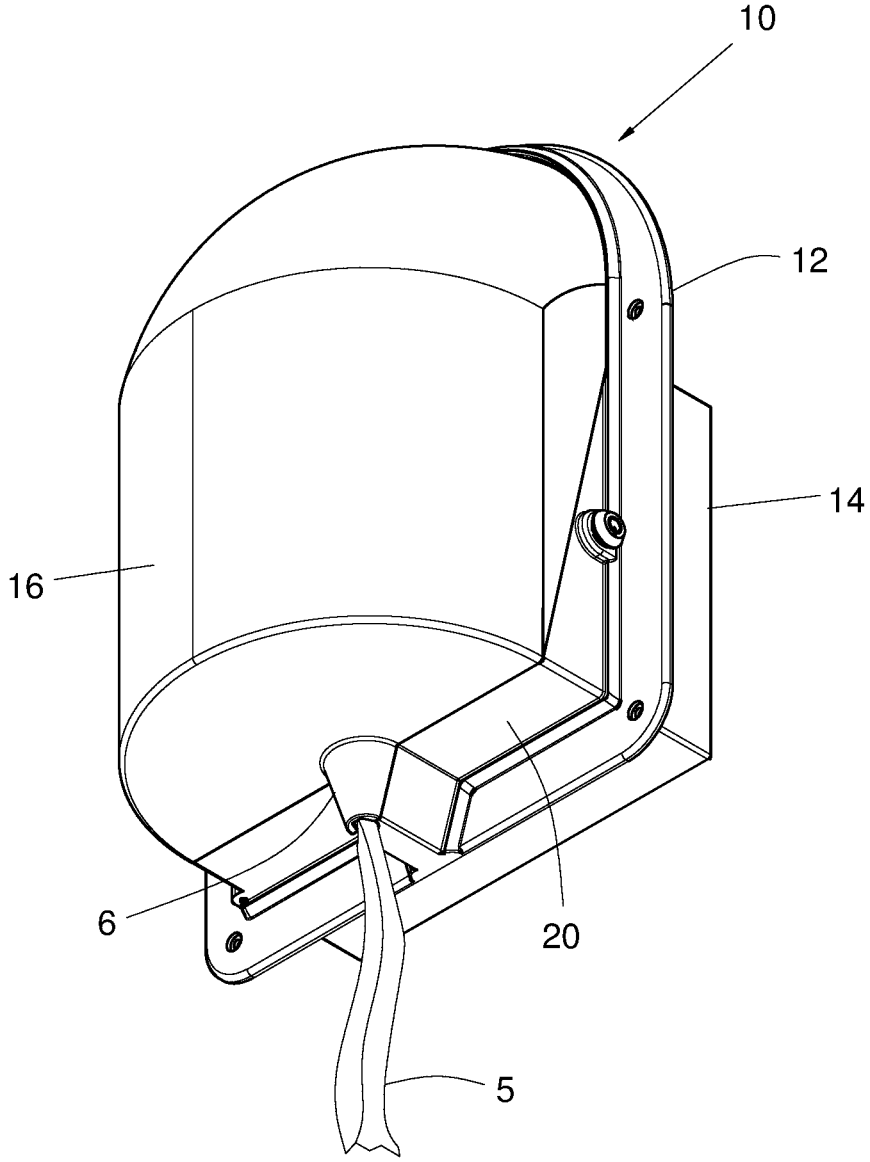
FIG. 1 is a perspective view of an example ligature-resistant paper towel dispenser 10.

Referring now to FIG. 1, a perspective view of an example ligature-resistant paper towel dispenser 10 is shown. Example ligature-resistant paper towel dispenser 10 includes a housing rear portion 12 that has a rear projection 14 for placement in a wall and a front extension 20 that connects with a housing front portion 16 that is secured over the housing rear portion 12 to enclose a roll of paper towels. An outlet 6 at the bottom of the housing formed by housing front portion 16 and housing rear portion 12 permits exit of an end 5 of the roll of paper towels to dispense individual paper towels.

Figure 2:
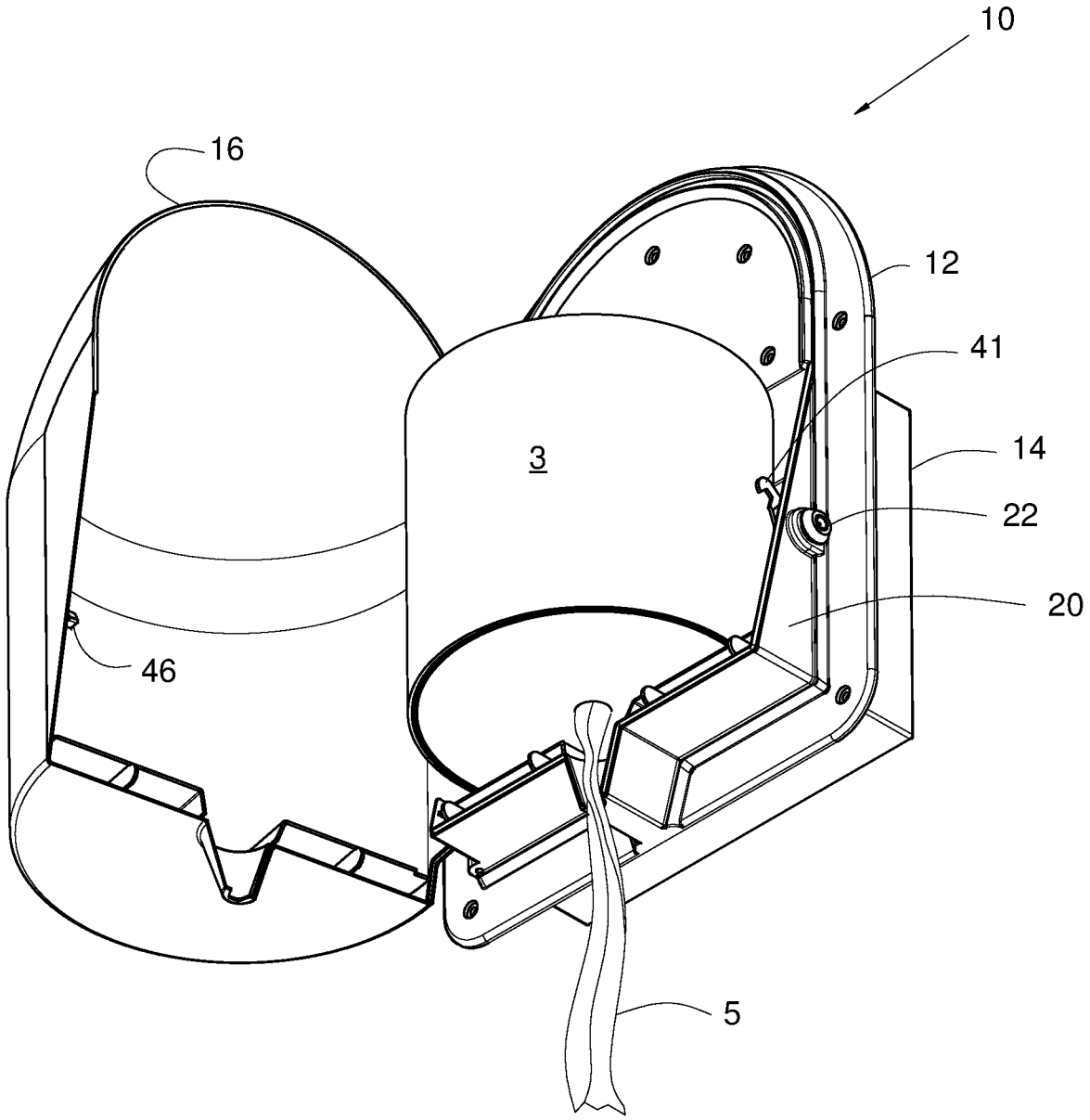
FIG. 2 is a perspective view of example ligature-resistant paper towel dispenser 10, with housing front portion 16 opened.

Referring now to FIG. 2, a perspective view of example ligature-resistant paper towel dispenser 10 is shown with housing front portion 16 opened to reveal a roll 3 of paper towels. Roll 3 is vertically-oriented, i.e., the axis around which roll 3 is formed is aligned with the vertical orientation of the housing of ligature-resistant paper towel dispenser 10. In order to install or remove roll 3, housing front portion 16, which forms a cover, is opened, as shown. A protrusion 46 is visible inside housing front portion 16, which is engaged by a hook 41 forming part of a locking mechanism 22 provided on front extension 20.

Figure 3:
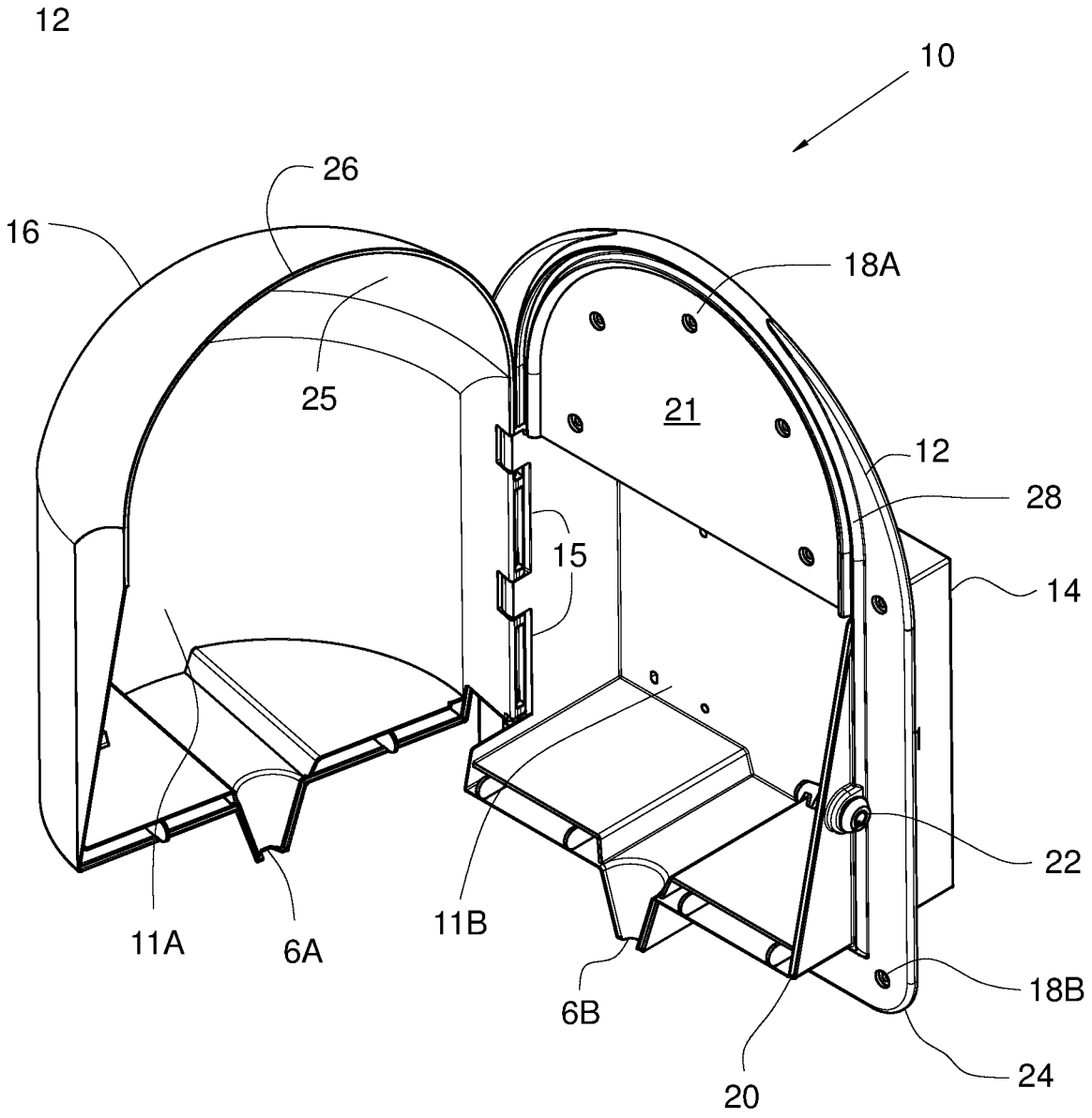
FIG. 3 is a perspective view of the example ligature-resistant paper towel dispenser 10, with housing front portion 16 opened and paper towel roll 3 removed.
Figure 11:
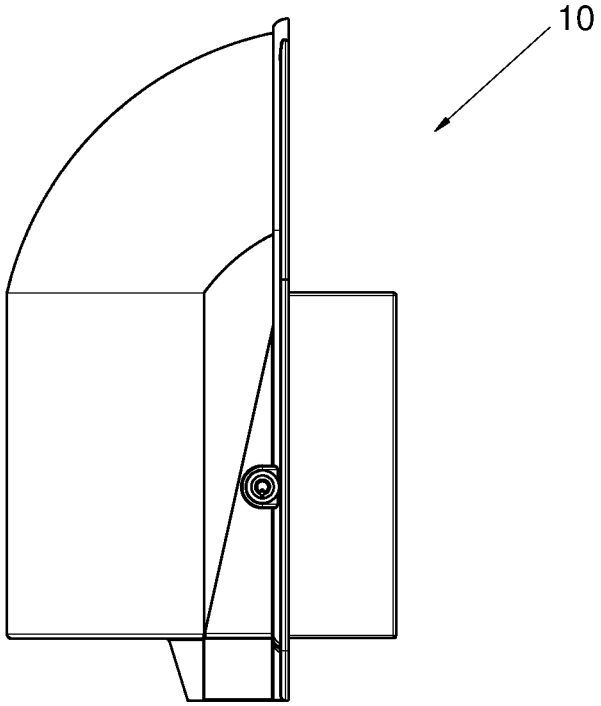
FIG. 11 is a right side view illustrating design features of example ligature-resistant paper towel dispenser 10.
Figure 14:
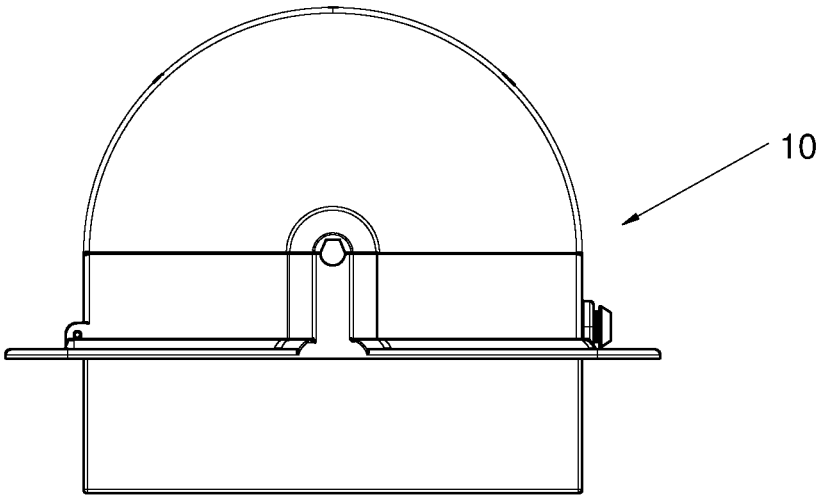
FIG. 14 is a bottom view illustrating design features of example ligature-resistant paper towel dispenser 10.

Referring now to FIG. 3, a perspective view of example ligature-resistant paper towel dispenser 10 is shown with housing front portion 16 opened and roll 3 removed. A hinge 15 is formed by a pin (not shown) that extends through hinge portions formed along the sides of housing front portion 16 and housing rear portion 12, and that retains housing front portion 16 to housing rear portion 12. Locking mechanism 22 disposed at the opposite side of housing rear portion 12 and on front extension 20 is used to secure housing front portion 16 over roll 3, when ligature-resistant paper towel dispenser 10 is available for use. Outlet 6 is formed by two semi-conical outlet portions 6A, 6B, formed in housing front portion 16 and housing rear portion 12, respectively, and that join together to form a conical passage when housing front portion 16 is secured to housing rear portion 12. Mounting voids 18A, 18B for screws, bolts or other suitable fasteners are provided along planar mounting surface 21 forming a rear surface of housing rear portion 12 with the exception of rear projection 14, i.e., the surface of ligature-resistant paper towel dispenser 10 that lies flush to a wall when ligature-resistant paper towel dispenser 10 is installed. Planar mounting surface 21 includes a flange 24 that surrounds housing rear portion 12 at the sides of ligature-resistant paper towel dispenser 10 and extends along the top of housing rear portion 12 to near an apex 26 of a hemispherical top projection 25 of housing front portion 16. Housing rear portion 12 forms the back of a hemispherical top extension of the housing of ligature-resistant paper towel dispenser 10, by providing a circular profile at a blind seam 28 that joins housing rear portion 12 with housing front portion 16, when the ligature-resistant paper towel dispenser 10 is secured in a closed position, so that a quarter-spherical shape is formed for ligature-resistance. Housing front portion 16 and housing rear portion 12 include towel recess portions 11A, and 11B, respectively, so that roll 3 (not shown) rests in towel recess portion 11B, as illustrated in FIG. 2, when housing front portion 16 is swung away from housing rear portion 12 and so that roll 3 extends into the wall to reduce the overall profile of ligature-resistant paper towel dispenser 10. Referring additionally to FIG. 11, the side profile of housing front portion 16 is shown in a left side view. The maximum upward projection h1 of housing front portion 16 is substantially equidistant with the depth dl from the maximum forward projection of housing front portion 16 to the wall, providing a hemispherical shape, i.e., a shape that has a circular cross section in the curved portion of top extension of housing front portion 16. Referring to FIG. 14, it is also apparent that housing front portion has a circular cross section in the horizontal plane, yielding a true quarter-spherical shape. However, a reduced height can provide ligature resistance, and a ratio of height h1 to depth dl in the range of ½ to 1 are contemplated, as well as steeper inclines in which the ratio of height h1 to depth dl is greater than 1.

Figure 4:
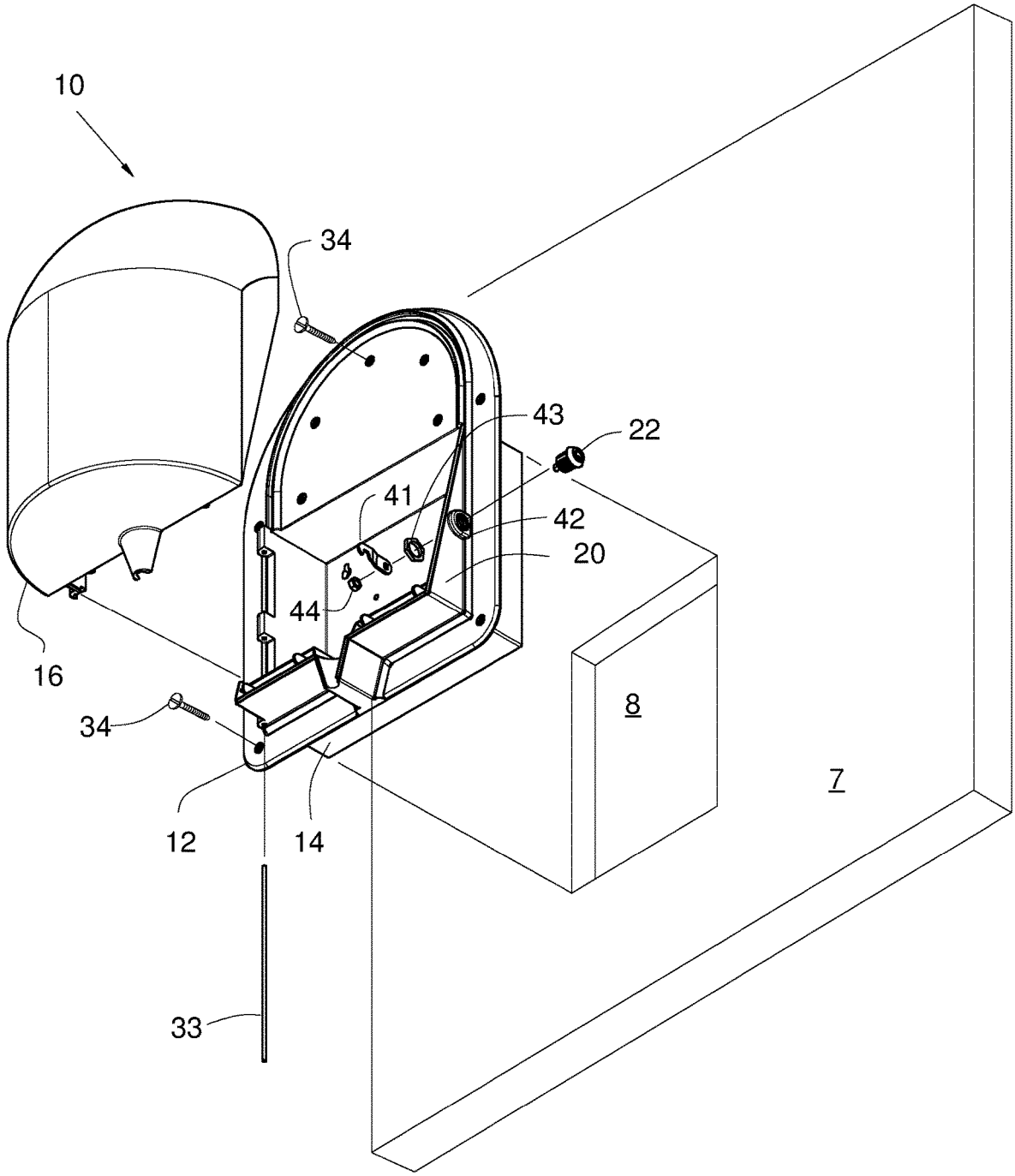
FIG. 4 is an exploded perspective view of an installation of example ligature-resistant paper towel dispenser 10.

Referring now to FIG. 4, a perspective view of an assembly of example ligature-resistant paper towel dispenser 10 to a wall 7 is shown. First, a rectangular aperture 8 is formed in wall 7 with dimensions sufficient to accommodate rear projection 14 of housing rear portion 12 and housing rear portion 12 is secured to wall 7 with fasteners 34. The exploded view of FIG. 4 also illustrates the relationship of the components of locking mechanism 22 and a hinge pin 32 which is inserted through the portions of hinge 15 formed on housing rear portion 12 and housing front portion 16. Locking mechanism 22 includes a keylock chamber 40 that is secured in a reinforced hole 42 through front extension 20 with a nut 43. Hook 41 is secured to keylock chamber 40 with a bolt 44. Hook 41 latches over protrusion 46 (not shown) of housing front portion 16, when a key is turned in keylock chamber 40.

Figure 5:
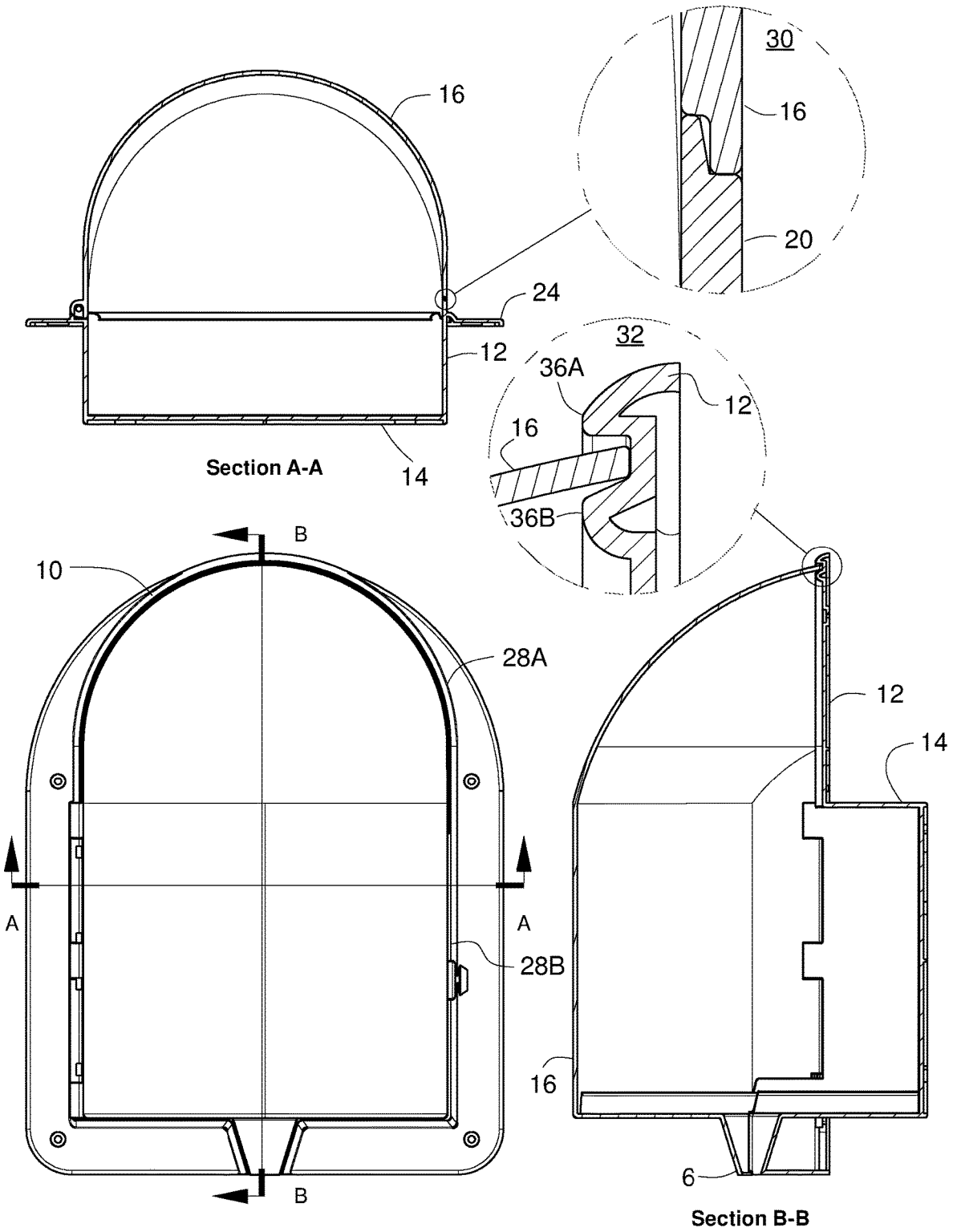
FIG. 5 is a front sectional view showing details of example ligature-resistant paper towel dispenser 10.
Figure 6:
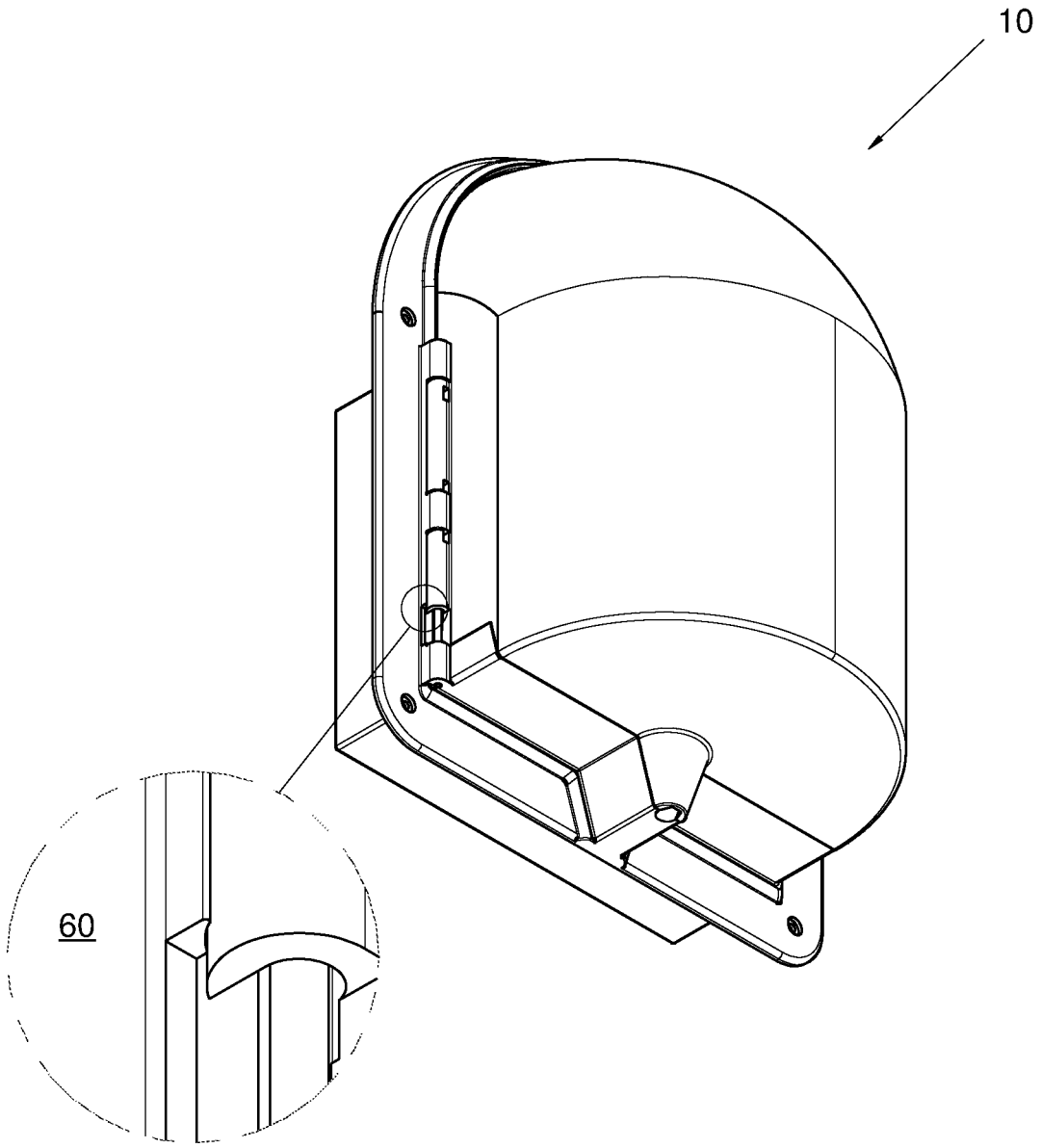
FIG. 6 is a perspective view illustrating details of a hinge 15 of example ligature-resistant paper towel dispenser 10.

Referring now to FIG. 5, a front sectional view of ligature-resistant paper towel dispenser 10 is shown. Section A-A shows the profile of a lower region of housing front portion 16 which is semi-circular at the front thereof and has parallel sides extending a short distance from flange 24 to the semi-circular portion of the profile of housing front portion 16. Blind seam 28A, 28B is provided completely around housing front portion, so that no gap is provided for insertion of a ligature. The circular profile extends completely around the cross-section of housing front portion 16 above the paper towel recess and rear projection 14 as illustrated in section B-B. Detail 30 shows an overlap provided by ship-lapped edges of front extension 20 of rear housing portion 12 and edges of front housing portion 16 forming part of the blind seam 28A prevents insertion of a ligature at the joint between front housing portion 16 and front extension 20. Detail 33 shows a seal provided by a double-ridged profile provided by ridges 36A, 36B of rear housing portion 12 and the edge of housing front portion 16 above front extension 20, forming the remainder of the blind seam 28B, which also prevents insertion of a ligature.

Figure 8:
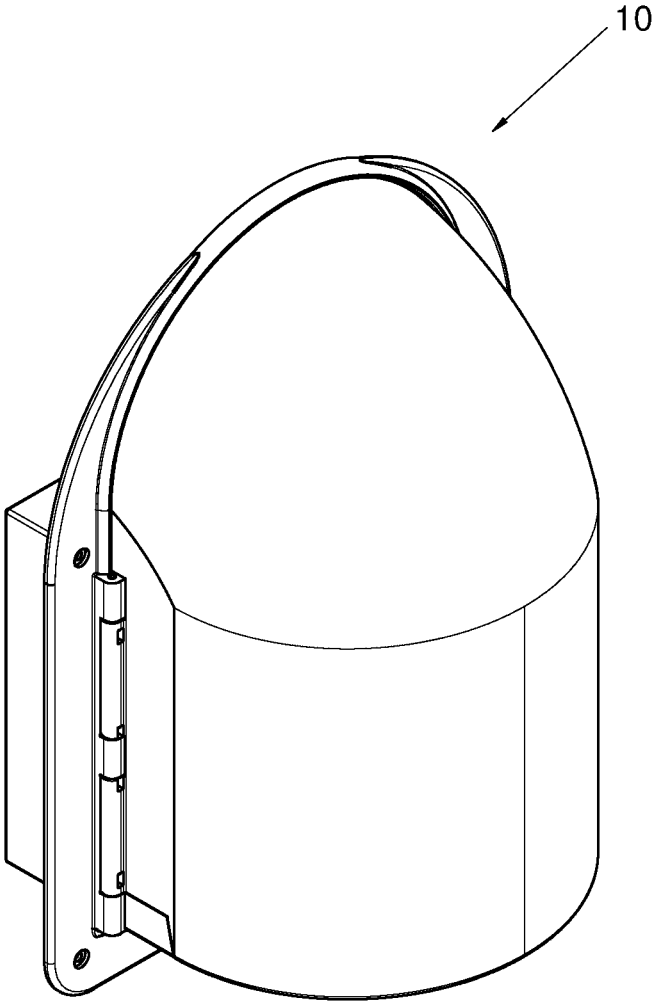
FIG. 8 is an upper-left perspective view illustrating design features of example ligature-resistant paper towel dispenser 10.

Referring now to FIG. 8, a perspective view of ligature-resistant paper towel dispenser 10 illustrates further details of the hinge 15 are shown. A blocking protrusion 60 is provided along the edge of housing rear portion 12 adjacent to hinge 15 and fills the a gap due to the cylindrical profile of the portions of hinge 15 on both housing rear portion 12 and housing front portion 16, so that a ligature cannot be looped through or placed into the gap.

Figure 7:
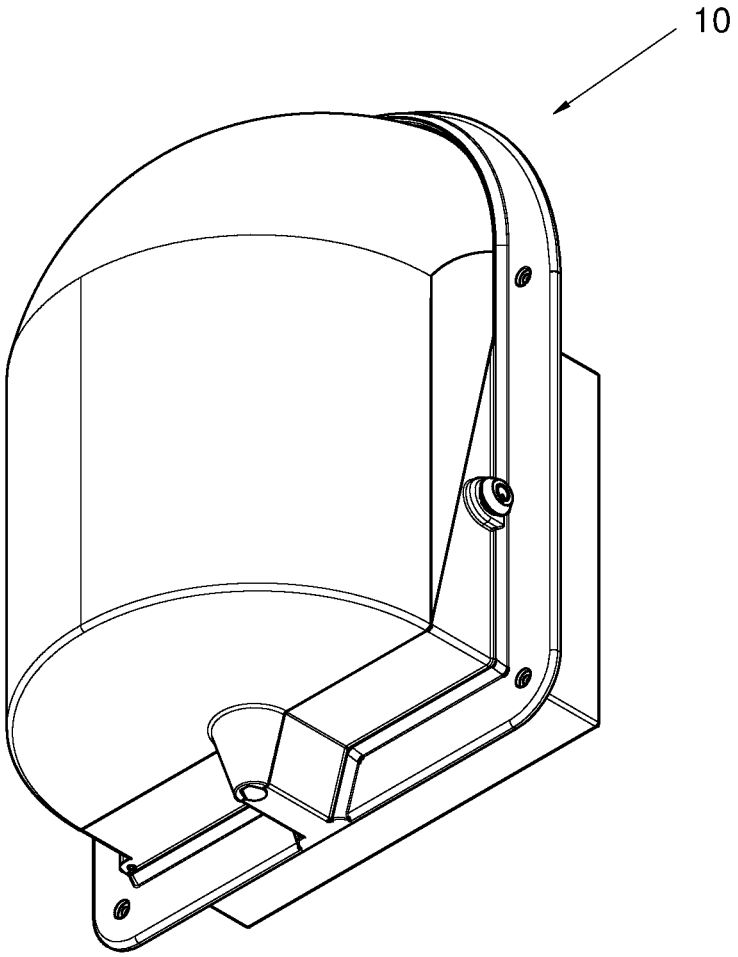
FIG. 7 is a lower-right perspective view illustrating design features of example ligature-resistant paper towel dispenser 10.
Figure 9:
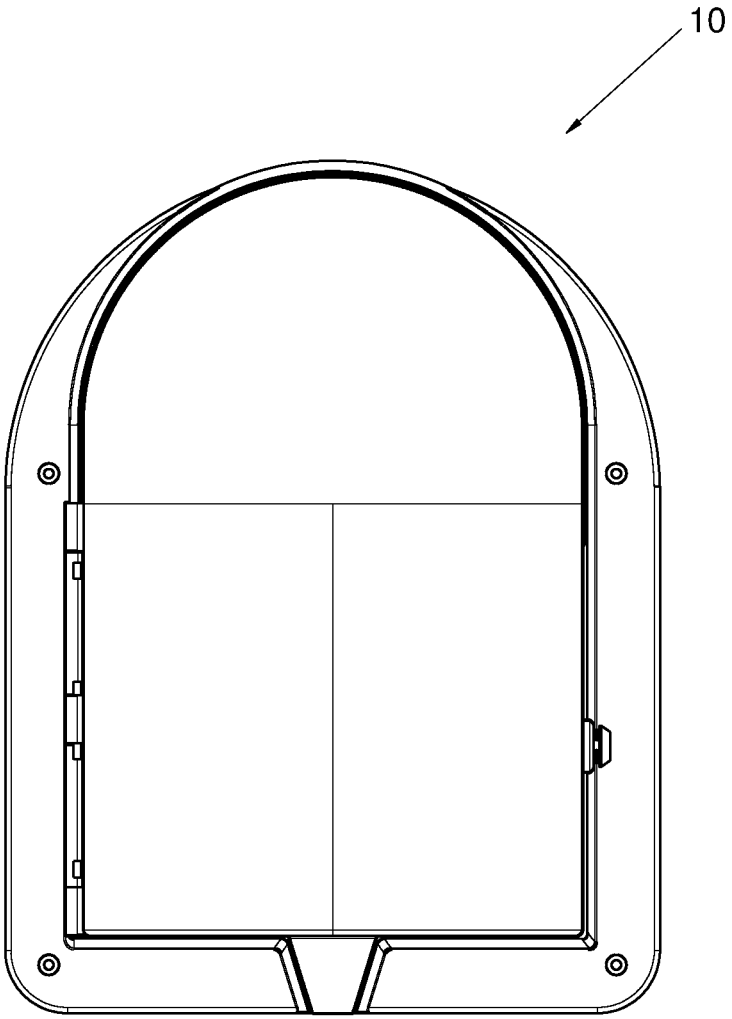
FIG. 9 is a front view illustrating design features of example ligature-resistant paper towel dispenser 10.
Figure 10:
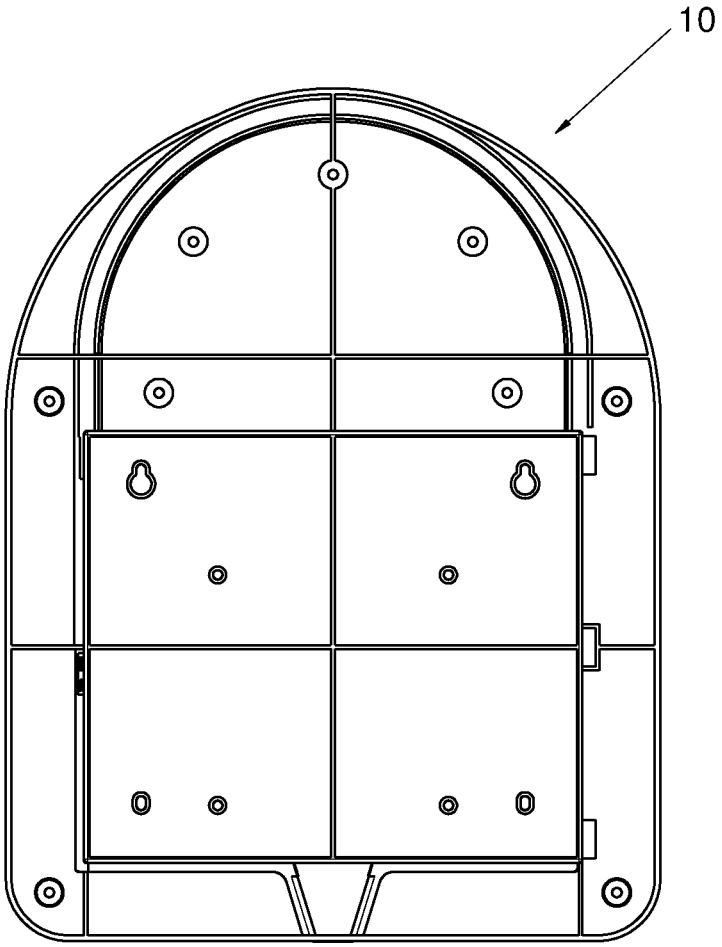
FIG. 10 is a rear view illustrating design features of example ligature-resistant paper towel dispenser 10.
Figure 12:
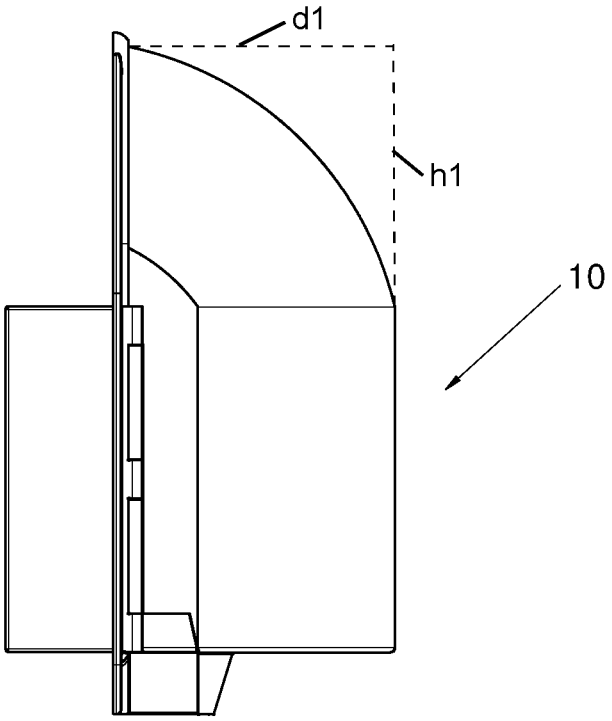
FIG. 12 is a left side view illustrating design features of example ligature-resistant paper towel dispenser 10.
Figure 13:
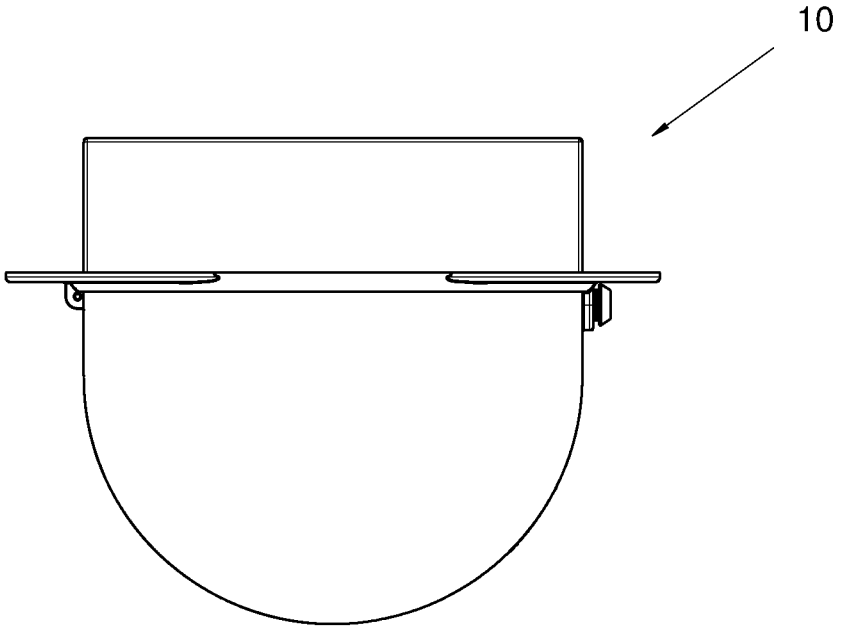
FIG. 13 is a top view illustrating design features of example ligature-resistant paper towel dispenser 10.

FIG. 7 through FIG. 14 depict design features of example ligature-resistant paper towel dispenser 10, in which FIG. 7 is a lower-right perspective view, FIG. 8 is an upper-left perspective view, FIG. 9 is a front view, FIG. 10 is a rear view, FIG. 11 is a right side view, FIG. 12 is a left side view, FIG. 13 is a top view and FIG. 14 is a bottom view illustrating design features of the above-described example ligature-resistant paper towel dispenser 10.

Figure 15:
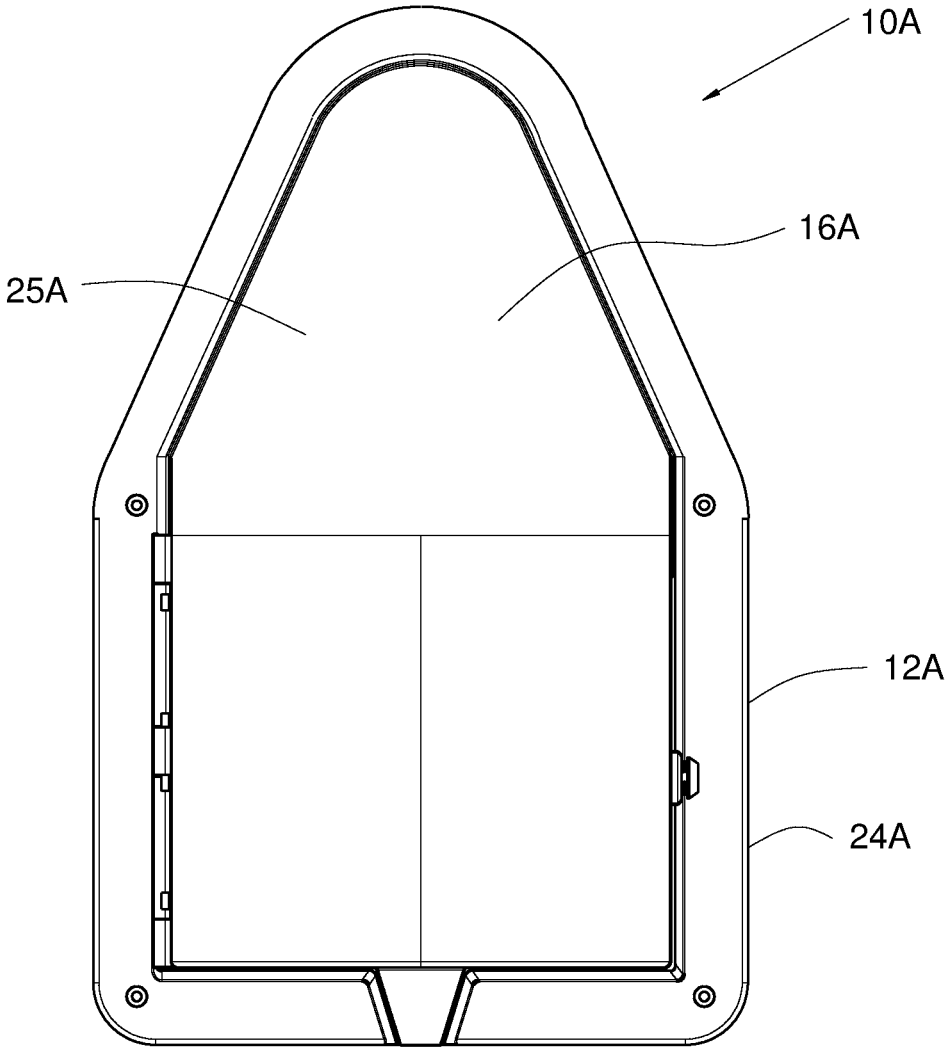
FIG. 15 is a front view illustrating another example ligature-resistant paper towel dispenser 10A.
Figure 16:
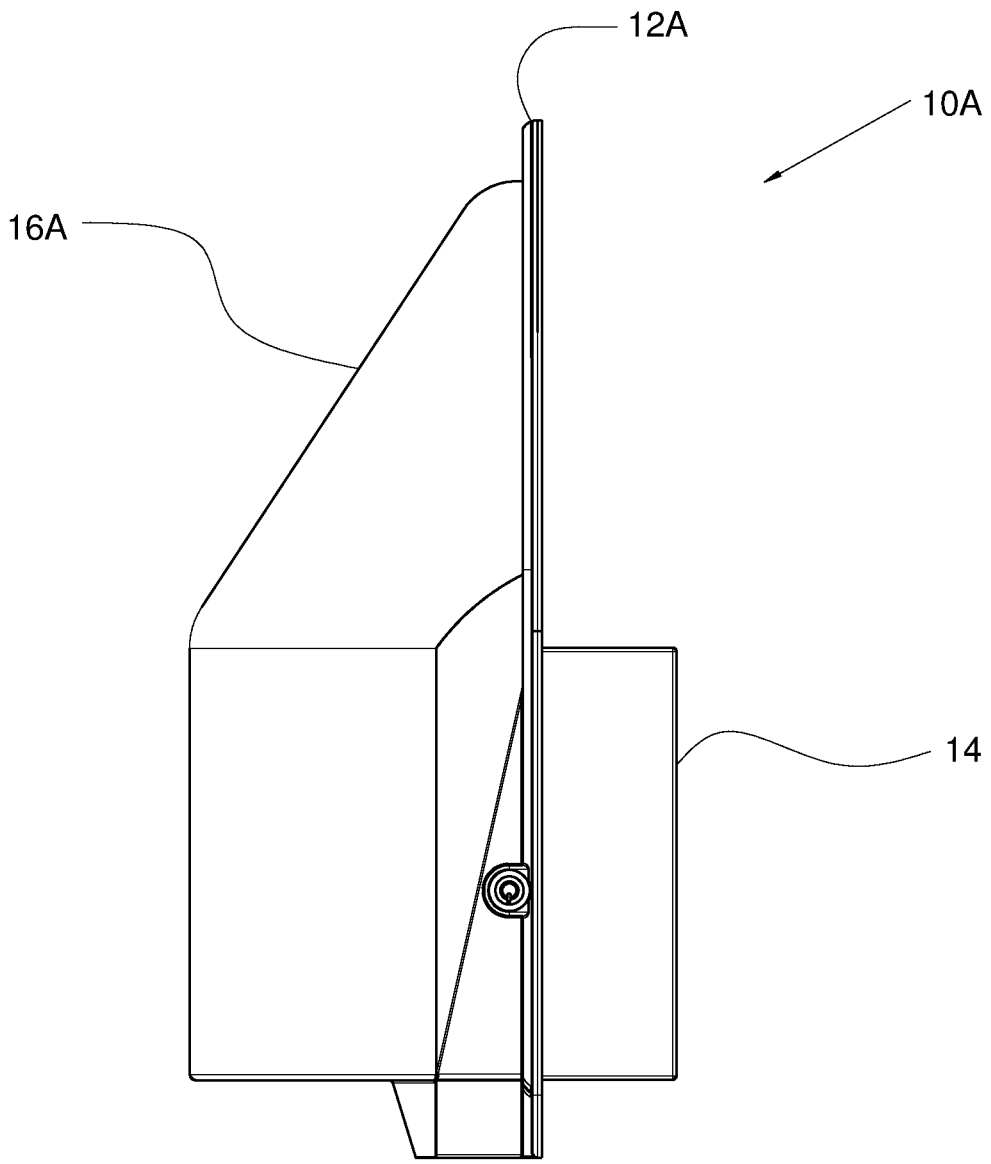
FIG. 16 is a side view illustrating example ligature-resistant paper towel dispenser 10A.

Referring now to FIG. 14 and FIG. 15, another example ligature-resistant paper towel dispenser 10A in accordance with another embodiment is shown. Ligature-resistant paper towel dispenser 10A is similar to ligature-resistant paper towel dispenser 10 described and shown above, with the difference that a top extension 25A of the housing of ligature-resistant paper towel dispenser 10A is inclined, rather than curved along the lower portion of the sides of the top extension 25A. Therefore, the sides of a housing front portion 16A and a housing rear portion 12A are also inclined to provide the proper mating seal along a flange 24A, as is the incline of housing front portion 16A in the direction perpendicular to the wall as seen in FIG. 15. The apex of housing front portion 16A is still curved to provide a rounded point, but the inclines of top extension 25A provide a conical shape that is ligature-resistant.

While the invention has been particularly shown and described with reference to the preferred embodiment thereof, it will be understood by those skilled in the art that the foregoing and other changes in form, and details may be made therein without departing from the spirit and scope of the invention.

What is claimed is:

1. A ligature-resistant paper towel dispenser comprising:

a housing having a towel recess for receiving a roll of paper towels in a vertical orientation such that a bottom inside surface of the towel recess supports a bottom end of the roll of paper towels and a top of the towel recess lies above a top end of the roll of paper towels, wherein a rear face of the housing has a planar mounting area for securing the ligature-resistant paper towel dispenser to a wall, wherein the housing has a top projection located above a top of the towel recess and having an exterior that is curved or inclined downward from an apex to prevent attachment of a ligature, wherein a curvature or slope of the exterior of the top projection extends continuously from the apex to a frontmost projection of the exterior of the housing, wherein the exterior of the top projection extends above the towel recess by a distance greater than or equal to half of a maximum forward projection of the exterior of the top projection from the wall to provide sufficient curvature or inclination of the exterior of the top projection of the housing;

an outlet disposed at the bottom of the housing through which an end of the roll of paper towels is extendable for dispensing paper towels from the roll of paper towels; and a locking mechanism for securing the housing over the roll of paper towels.

2. The ligature-resistant paper towel dispenser of claim 1, wherein the housing top projection is hemispherical.

3. The ligature-resistant paper towel dispenser of claim 1, wherein the housing has a rear projection that extends backwards from the planar mounting area for insertion into an aperture formed through a surface of the wall, so that the towel recess projects into the wall.

4. The ligature-resistant paper towel dispenser of claim 3, wherein the housing comprises:

a housing rear portion incorporating a first portion of the towel recess, the rear projection, the planar mounting area and a first portion of the top projection; and a housing front portion having a second portion of the towel recess for placement over a front portion of the roll of paper towels and a second portion of the top projection, wherein the housing front portion and the housing rear portion join at a blind seam extending around the apex of the top projection and along both sides of the housing to prevent insertion of a ligature, and wherein the locking mechanism secures the housing front portion to the housing rear portion.

5. The ligature-resistant paper towel dispenser of claim 4, further comprising a first hinge portion formed on a first side of the housing rear portion opposite the locking mechanism, a corresponding second hinge portion formed on a corresponding first side of the housing front portion and one or more pins that secure the housing front portion to the housing rear portion by extending through the first hinge portion and the second hinge portion, wherein the housing rear portion further comprises a blocking protrusion that prevents access around the first and second hinge portions when the housing front portion is secured to the housing rear portion.

6. The ligature-resistant paper towel dispenser of claim 4, wherein the outlet is formed by a first partial conical passage located at a front of a bottom face of the housing rear portion and another partial conical passage located at a rear of a bottom face of the housing front portion.

7. The ligature-resistant paper towel dispenser of claim 3, further comprising mounting voids extending from within the top projection of the housing rear portion through the planar mounting area for securing the housing rear portion to the wall.

8. The ligature-resistant paper towel dispenser of claim 3, wherein the planar mounting area includes a flange extending around the periphery of the housing on a top and sides thereof and at least partially around a bottom of the housing.

9. The ligature-resistant paper towel dispenser of claim 8, wherein the flange terminates on either side of the outlet and wherein a rear of the outlet forms part of the planar mounting surface between ends of the flange, whereby the flange and the outlet provide a continuous seal to the wall when the housing is mounted to the wall.

10. The ligature-resistant paper towel dispenser of claim 1, wherein the exterior of the top projection extends above the towel recess by a distance greater than or equal to the maximum forward projection of the exterior of the top projection from the wall.

11. The ligature-resistant paper towel dispenser of claim 1, wherein the top projection of the housing defines an empty volume extending from a top of the towel recess and to an inner surface of the housing directly beneath the apex.

12. The ligature-resistant paper towel dispenser of claim 1, wherein the housing comprises:

a housing rear portion incorporating a first portion of the towel recess, the rear projection, the planar mounting area and a first portion of the top projection; and a housing front portion having a second portion of the towel recess for placement over a front portion of the roll of paper towels and a second portion of the top projection, wherein a bottom inner surface of the housing front portion and a bottom inner surface of the housing rear portion support the bottom end of the roll of paper towels, and wherein the locking mechanism secures the housing front portion to the housing rear portion.

13. A ligature-resistant paper towel dispenser, comprising:

a housing rear portion having a first towel recess for receiving a roll of paper towels, wherein the alignment of the first towel recess is such that a central axis of the roll is oriented along a vertical direction, wherein the housing rear portion has a planar mounting area for securing the ligature-resistant paper towel dispenser to a wall, wherein the planar mounting area surrounds a rear projection of the housing that extends backwards from the planar mounting area into an aperture formed through a surface of the wall so that the first towel recess projects into the wall, wherein the housing rear portion has a hemispherical top projection having an exterior that is curved downward from an apex to prevent attachment of a ligature, wherein the exterior of the hemispherical top projection extends above the towel recess by a distance greater than or equal to half of a maximum forward projection of the exterior of the top projection from the wall to provide sufficient curvature or inclination of the exterior of the top projection of the housing;

a housing front portion having a second towel recess for placement over a front portion of the roll of paper towels and a hemispherical top projection that extends above the second towel recess by the distance greater than a maximum forward projection of the exterior of the top projection from the wall, wherein the hemispherical top projection of the housing front portion is curved or inclined to match the curve or incline of the hemispherical top projection of the housing rear portion wherein the housing front portion and the housing rear portion join at a blind seal extending around the apex of the hemispherical top projection and along both sides of the housing to prevent insertion of a ligature;

an outlet disposed at the bottom of the ligature-resistant paper towel dispenser through which an end of the roll of paper towels is extendable for dispensing the paper towels, wherein the outlet is formed by a first partial conical passage located at a front of a bottom face of the housing rear portion and another partial conical passage located at a rear of a bottom face of the housing front portion, wherein the planar mounting surface of the housing rear portion includes a flange extending around the periphery of the housing rear portion on a top and sides thereof and terminates on either side of the outlet, and wherein a rear of the outlet forms part of the planar mounting surface between ends of the flange, whereby the flange and the outlet provide a continuous seal to the wall when the housing rear portion is mounted to the wall, wherein the hemispherical top projection of the housing front portion and the hemispherical top projection of the housing rear portion define an empty volume above the first towel recess and the second towel recess that extends to the interior of the housing rear portion directly beneath the apex; a first hinge portion formed on a first side of the housing rear portion opposite the locking mechanism, a corresponding second hinge portion formed on a corresponding first side of the housing front portion and one or more pins that secure the housing front portion to the housing rear portion by extending through the first hinge portion and the second hinge portion, wherein the housing rear portion further comprises a blocking protrusion that prevents access around the first and second hinge portions when the housing front portion is secured to the housing rear portion; and a locking mechanism that secures the housing front portion to the housing rear portion.

14. A method of dispensing paper towels, while preventing formation or support of a ligature at the location of the dispensing, the method comprising:

mounting a housing of a ligature-resistant paper towel dispenser to a wall, the housing having a towel recess for receiving a roll of paper towels, by securing a planar mounting area provided at a rear face of the housing, wherein the housing has a top projection located above a top of the towel recess and having an exterior that is curved or inclined downward from an apex to prevent attachment of a ligature, wherein a curvature or slope of the exterior of the top projection extends continuously from the apex to a frontmost projection of the exterior of the housing, wherein the exterior of the top projection extends above the towel recess by a distance greater than or equal to half of a maximum forward projection of the exterior of the top projection from the wall to provide sufficient curvature or inclination of the exterior of the top projection of the housing;

inserting a roll of paper towels into the towel recess in a vertical orientation such that a bottom inside surface of the towel recess supports a bottom end of the roll of paper towels and a top of the towel recess lies above a top end of the roll of paper towels;

securing the housing over the roll of paper towels with a locking mechanism; and dispensing the paper towels from an outlet disposed at the bottom of the ligature-resistant paper towel dispenser through which individual paper towels extend from the roll and a portion of which extends through the outlet for dispensing the paper towels.

15. The method of claim 14, wherein the housing top projection is hemispherical.

16. The method of claim 14, wherein the mounting further inserts a rear projection of the housing that extends backwards from the planar mounting area into an aperture formed through a surface of the wall so that the towel recess projects into the wall.

17. The method of claim 16, wherein the mounting mounts a housing rear portion of the housing to the wall, the housing rear portion incorporating the planar mounting area, the rear projection, a first portion of the towel recess and a first portion of the top extension of the housing, wherein the inserting inserts the roll of paper towels into the first portion of the towel recess, wherein the securing comprises covering a front of the roll of paper towels by securing a housing front portion of the housing over the roll of paper towels, the housing front portion having a second portion of the towel recess for placement over a front portion of the roll of paper towels and a second portion of the top projection of the housing, wherein the housing front portion and the housing rear portion join at a blind seam extending around the apex of the top projection and along both sides of the housing to prevent insertion of a ligature, and wherein the securing secures the housing front portion to the housing rear portion.

18. The method claim 17, wherein the outlet is formed by a first partial conical passage located at a front of a bottom face of the housing rear portion and another partial conical passage located at a rear of a bottom face of the housing front portion.

19. The method of claim 17, wherein the securing is further provided by a first hinge portion formed on a first side of the housing rear portion opposite the locking mechanism, a corresponding second hinge portion formed on a corresponding first side of the housing front portion and one or more pins that secure the housing front portion to the housing second portion by extending through the first hinge portion and the second hinge portion, wherein the housing rear portion further comprises a blocking protrusion that prevents access around the first and second hinge portions when the housing front portion is secured to the housing rear portion.

20. The method of claim 14, wherein the planar mounting area includes a flange extending around the periphery of the housing on a top and sides thereof and at least partially around a bottom of the housing.

21. The method of claim 20, wherein the flange terminates on either side of the outlet and wherein a rear of the outlet forms part of the planar mounting surface between ends of the flange, whereby the flange and the outlet provide a continuous seal to the wall when the housing is mounted to the wall.

22. The method of claim 14, wherein the exterior of the top projection extends above the towel recess by a distance greater than or equal to the maximum forward projection of the exterior of the top projection from the wall.

23. The method of claim 14, wherein the top projection of the housing defines an empty volume above the towel recess extends from a top of the towel recess to the interior of the housing directly beneath the apex.

24. The method of claim 14, wherein the mounting mounts a housing that includes a housing rear portion incorporating a first portion of the towel recess, the rear projection, the planar mounting area and a first portion of the top projection, and a housing front portion having a second portion of the towel recess for placement over a front portion of the roll of paper towels and a second portion of the top projection, wherein a bottom inner surface of the housing front portion and a bottom inner surface of the housing rear portion support the bottom end of the roll of paper towels, and wherein the securing secures the housing front portion to the housing rear portion with the locking mechanism.

* * * * *